US006899460B2

(12) United States Patent
Turvey et al.

(10) Patent No.: US 6,899,460 B2
(45) Date of Patent: May 31, 2005

(54) STORAGE BAG WITH OPENLY BIASED MOUTH

(75) Inventors: Robert R. Turvey, Sanford, MI (US); Michael J. Banco, Racine, WI (US); James C. Pawloski, Bay City, MI (US); Kenneth A. Toney, Baton Rouge, LA (US); John O. McCree, Bay City, MI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 123 days.

(21) Appl. No.: 10/272,579

(22) Filed: Oct. 16, 2002

(65) Prior Publication Data

US 2003/0077007 A1 Apr. 24, 2003

Related U.S. Application Data

(60) Provisional application No. 60/336,442, filed on Oct. 23, 2001.

(51) Int. Cl.[7] ..... B65D 33/00

(52) U.S. Cl. ..... 383/33; 383/34; 383/63; 383/64

(58) Field of Search ..... 383/33, 34, 34.1, 383/35, 63, 64

(56) References Cited

U.S. PATENT DOCUMENTS

| | | | | |
|---|---|---|---|---|
| 2,283,069 A | | 5/1942 | Knuetter | |
| 2,695,129 A | | 11/1954 | Stahmer | |
| 3,310,224 A | * | 3/1967 | Laguerre | 383/15 |
| 3,366,312 A | | 1/1968 | Lowenberg et al. | |
| 3,437,258 A | | 4/1969 | Kugler | |
| 3,438,567 A | | 4/1969 | Bell | |
| 3,980,225 A | | 9/1976 | Kan | |
| 4,317,478 A | | 3/1982 | Babbidge | |
| 4,353,497 A | | 10/1982 | Bustin | |

(Continued)

FOREIGN PATENT DOCUMENTS

| | | |
|---|---|---|
| EP | 0345838 | 12/1989 |
| WO | WO 98/47781 | 10/1998 |

*Primary Examiner*—Jes F. Pascua

(57) ABSTRACT

A storage bag having a recloseable mouth, which is biased into an open configuration, is disclosed. The bag, typically manufactured from thermoplastic material such as low-density polyethylene, includes first and second adjacent layers joined or folded along bottom and side edges. The top edges are not folded or permanently joined, but are provided with closure members such as mating male and female zipper strips. The bag is further provided with structure to bias the top edges apart from one another thus biasing the mouth of the bag into an open configuration. The closure members are sufficiently strong to overcome the force of the biasing structure and thereby hold the bag closed when the closure members are engaged. However, upon disengagement of the closure members the biasing structure forces the bag top edges apart to thereby place the bag into an open mouth configuration.

11 Claims, 15 Drawing Sheets

U.S. PATENT DOCUMENTS 4,541,117 A * 9/1985 Ashbeck ..... 383/64
4,593,408 A 6/1986 Drobish et al.
4,621,000 A 11/1986 Frick
4,679,701 A 7/1987 Ackermann et al.
4,736,450 A 4/1988 Van Erden et al.
4,869,725 A * 9/1989 Schneider et al. ..... 604/408
4,898,477 A * 2/1990 Cox et al. ..... 383/33
4,934,535 A 6/1990 Muckenfuhs et al.
4,966,286 A 10/1990 Muckenfuhs
5,037,138 A * 8/1991 McClintock et al. ..... 383/34
5,044,774 A 9/1991 Bullard et al.
5,070,584 A 12/1991 Dais et al.
5,140,727 A 8/1992 Dais et al.
5,174,658 A * 12/1992 Cook et al. ..... 383/33
5,184,896 A * 2/1993 Hammond et al. ..... 383/33
5,216,787 A 6/1993 Custer et al.
5,242,516 A 9/1993 Custer et al.
5,246,122 A 9/1993 Schick et al.
5,267,795 A 12/1993 Bernstein et al.
5,344,691 A 9/1994 Hanschen et al.
5,354,132 A * 10/1994 Young et al. ..... 383/49
5,364,189 A 11/1994 Kuge et al.
5,375,930 A 12/1994 Tani
5,380,094 A 1/1995 Schmidt et al.
5,385,527 A 1/1995 Fukada et al.
5,404,999 A 4/1995 Bednar
5,478,152 A 12/1995 Bogle
5,529,394 A 6/1996 Davoren
5,564,829 A 10/1996 Lafond
5,617,770 A 4/1997 May
5,647,100 A 7/1997 Porchia et al.
5,647,670 A 7/1997 Iscovich
5,716,138 A 2/1998 Southwell
5,785,428 A 7/1998 Mazzocchi
5,788,378 A 8/1998 Thomas
5,852,830 A * 12/1998 Horn ..... 4/144.1
5,996,882 A 12/1999 Randall
6,022,144 A 2/2000 Hausslein
6,074,097 A 6/2000 Hayashi et al.
6,092,687 A 7/2000 Hupp et al.
6,116,501 A 9/2000 Hupp
6,116,782 A 9/2000 Arkins et al.
6,212,716 B1 * 4/2001 Logan et al. ..... 5/644
6,290,392 B1 9/2001 Sandor
6,393,804 B1 5/2002 Ausnit
2003/0215160 A1 11/2003 Kohl et al.

* cited by examiner

STORAGE BAG WITH OPENLY BIASED MOUTH

CROSS-REFERENCE TO RELATED APPLICATIONS

This application claims priority to provisional patent application Ser. No. 60/336,442, filed on Oct. 23, 2001.

FIELD OF THE DISCLOSURE

The present disclosure generally relates to storage bags and, more particularly, relates to recloseable storage bags having an ability to maintain an open position facilitating filling.

BACKGROUND OF THE DISCLOSURE

Storage bags are well known. Such bags can be manufactured from a variety of materials including, but not limited to, paper and plastic. Paper is often the material of choice when the article or articles to be stored are dry or solid goods. Paper is also often selected for aesthetic or traditional reasons as with upscale clothing stores providing loop handled paper bags, or grocery stores where kraft paper bags have traditionally been employed.

However, if perishable goods such as, but not limited to, food products, are to be stored, paper has a very limited effectiveness given its porosity and inability to be sealed. Plastic bags, particularly those manufactured from thermoplastic materials such as, but not limited to, high and low density polyethylene, have accordingly become the dominant product of choice in the area of food storage bags. Such material is fluid impermeable, relatively inexpensive, and can be manufactured in transparent form thereby facilitating content identification.

Such thermoplastic bags are also typically provided so as to be recloseable and substantially sealable. One common approach to provide such features employs closure members at a top edge of a bag having first and second thermoplastic layers folded or heat sealed along bottom and first and second side edges. The closure members may be provided in the form of mating male and female profiles such as those provided by the present assignee under the ZIPLOC® trademark. The male and female profiles are also typically manufactured from plastic, with the male profile including a linear tab adapted to be interlocked with a linear groove of the female profile.

The male and female profiles can be connected to close the bag by pinching and pulling across the closure members along the length of the top edges. Such motion can be accomplished as with the thumb and forefinger of a user, or through the use of a sliding element mounted to the male and female profiles, as is the case with bags provided by the present assignee under the ZIPLOC® trademark as well.

While such bags have been met with extraordinary commercial success from their inception until the present day, the assignee continues to improve its product offerings. One area, which the assignee has identified as being advantageously improved, involves the ability of the bag to pop open, as well as maintain an open configuration. More specifically, as indicated above, such bags typically include closed bottom and side edges and an open, but recloseable, top edge. If the bag is not gusseted, the top edges tend to stay adjacent one another regardless of whether the male and female profiles are engaged. This may be problematic, as when attempting to fill the bag, in that the user must hold the bag open with one hand while filling the bag with the other.

Moreover, the user is often frustrated in not knowing if the bag is in fact open.

The industry has therefore begun to provide such thermoplastic storage bags with a stay-open feature. Such bags may be provided with semi-rigid plastic strips provided proximate the top edges of the bag. The strips may be molded about an arcuate mandrel or cylinder so as to have a relaxed, bowed configuration and a stressed, flattened configuration. When the male and female closure elements are engaged, the strips are held in the stressed, flattened configuration, but when the closure members are disengaged, the strips return to their relaxed, bowed configuration, thereby holding the bag open. U.S. Pat. No. 4,898,477 is one example of such a stay-open bag.

While such bags provide a stay-open feature, it would be advantageous to provide alternative forms of thermoplastic storage bags, having a stay open feature, which are less expensive to manufacture and which provide improved ability to snap into an open configuration immediately upon disengaging the male and female profiles.

SUMMARY OF THE DISCLOSURE

In accordance with one aspect of the disclosure, a recloseable storage bag is provided which includes first and second sides, closure members and biasing rails. The first side includes a bottom edge, left edge, right edge, top edge, inner surface, and outer surface. The second side includes a bottom edge, left edge, right edge, top edge, inner surface, and outer surface. The bottom edges of the first and second sides are attached, the left edges of the first and second sides are attached, and the right edges of the first and second sides are attached. The closure members are provided proximate the top edges of the first and second sides. The biasing rails are attached to the first and second sides, and each have a relaxed, outwardly biased configuration, and a stressed, flat configuration. The closure members have a closure force, while the biasing rails have an opening force. The closure force is greater than the opening force, and each biasing rail includes a plurality of hinged segments.

In accordance with another feature of the disclosure a method of forming a recloseable storage bag is provided which comprising the steps of traversing a sheet of thermoplastic film around a cylinder, simultaneously traversing a biasing rail having a plurality of hinged segments around the cylinder in engagement with the sheet of thermoplastic film, attaching each hinge segment to the sheet of thermoplastic film, and folding the sheet of thermoplastic film into a bag having an openable top.

In accordance with another aspect of the disclosure, a recloseable storage bag is provided which includes first and second sides, closure members and biasing rails. The first side includes a bottom edge, left edge, right edge, top edge, inner surface, and outer surface. The second side includes a bottom edge, left edge, right edge, top edge, inner surface, and outer surface. The bottom edges of the first and second sides are attached, the left edges of the first and second sides are attached, and the right edges of the first and second sides are attached. The closure members are provided proximate the top edges of the first and second sides. The biasing rails are attached to the first and second sides, and each have a relaxed, outwardly biased configuration, and a stressed, flat configuration. The closure members have a closure force, while the biasing rails have an opening force. The closure force is greater than the opening force. Each biasing rail is deformed on at least one side to have the outwardly biased configuration.

In accordance with another aspect of the disclosure, a recloseable storage bag is provided which includes first and second sides, closure members and biasing rails. The first side includes a bottom edge, left edge, right edge, top edge, inner surface, and outer surface. The second side includes a bottom edge, left edge, right edge, top edge, inner surface, and outer surface. The bottom edges of the first and second sides are attached, the left edges of the first and second sides are attached, and the right edges of the first and second sides are attached. The closure members are provided proximate the top edges of the first and second sides. The biasing rails are attached to the first and second sides, and each have a relaxed, outwardly biased configuration, and a stressed, flat configuration. The closure members have a closure force, while the biasing rails have an opening force. The closure force is greater than the opening force, and each biasing rail being elastic.

In accordance with another aspect of the disclosure, a recloseable storage bag is provided which includes first and second sides, closure members and biasing rails. The first side includes a bottom edge, left edge, right edge, top edge, inner surface, and outer surface. The second side includes a bottom edge, left edge, right edge, top edge, inner surface, and outer surface. The bottom edges of the first and second sides are attached, the left edges of the first and second sides are attached, and the right edges of the first and second sides are attached. The closure members are provided proximate the top edges of the first and second sides. The biasing rails are attached to the first and second sides, and each have a relaxed, outwardly biased configuration, and a stressed, flat configuration. The closure members have a closure force, while the biasing rails have an opening force. The closure force is greater than the opening force, with each biasing rail having a polarity, and each of the polarities of the biasing rails being the same.

In accordance with another aspect of the disclosure, a recloseable storage bag is provided which includes first and second sides, closure members and biasing rails. The first side includes a bottom edge, left edge, right edge, top edge, inner surface, and outer surface. The second side includes a bottom edge, left edge, right edge, top edge, inner surface, and outer surface. The bottom edges of the first and second sides are attached, the left edges of the first and second sides are attached, and the right edges of the first and second sides are attached. The closure members are provided proximate the top edges of the first and second sides. The biasing rails are attached to the first and second sides, and each have a relaxed, outwardly biased configuration, and a stressed, flat configuration. The closure members have a closure force, while the biasing rails have an opening force. The closure force is greater than the opening force. Each biasing rail includes first and second layers of different lengths.

In accordance with another aspect of the disclosure, a recloseable storage bag is provided which comprises a pouch having an access way to an interior storage area of the pouch, a closure device proximate to the access way, the closure device being moveable between an engaged position closing the access way and a disengaged position opening the access way, and means for biasing the access way into an open configuration when the closure device is disengaged, the means for biasing including a rail having a plurality of hinged segments.

In accordance with another aspect of the disclosure, a recloseable storage bag is provided which comprises a pouch having an access way to an interior storage area of the pouch, a closure device proximate to the access way, the closure device being moveable between an engaged position closing the access way and a disengaged position opening the access way, and means for biasing the access way into an open configuration when the closure device is disengaged, the means for biasing including multiple layers.

In accordance with another aspect of the disclosure, a recloseable storage bag is provided which comprises a pouch having an access way to an interior storage area of the pouch, a closure device proximate to the access way, the closure device being moveable between engaged position closing the access way and a disengaged position opening the access way, and means for biasing the access way into an open configuration when the closure device is disengaged, the means for biasing including rails having deformations therein, the deformations causing the rails to be biased apart.

In accordance with another aspect of the disclosure, a recloseable storage bag is provided which comprises a pouch having an access way to an interior storage area of the pouch, a closure device proximate to the access way, the closure device being moveable between engaged position closing the access way and a disengaged position opening the access way, and means for biasing the access way into an open configuration when the closure device is disengaged, the means for biasing including similar polarized elements.

In accordance with another aspect of the disclosure, a method of manufacturing a recloseable storage bag is provided which comprises the steps of forming a rail and closure strip subassembly, connecting the rail and closure strip subassembly to a web of thermoplastic material, compressing the rail into an elongated form, and manipulating the web and connected rail and closure strip subassembly into a bag having an opening with the rail and closure strip subassembly proximate the opening.

In accordance with another aspect of the disclosure, a method of manufacturing a recloseable storage bag is provided which comprises the steps of forming rail of plastic material having first and second opposed sides, deforming one of the first and second sides so as to have a bow therein, attaching the rail to a web of thermoplastic material, and manipulating the web of thermoplastic material into a bag having a mouth, the bow of the rail being positioned so as to bias the mouth into an open configuration.

In accordance with another aspect of the disclosure, a recloseable storage bag is disclosed which may comprise a first side, second side, and closure members provided proximate the top edges of the first and second sides and each of which are biased and arcuate shapes.

In accordance with yet another aspect of the disclosure, a recloseable storage bag is disclosed which may comprise a first side, second side, closure members provided proximate top edges of the first and second sides, and closure members provided proximate the top edges of the first and second sides.

These and other aspects and features of the present disclosure will become more apparent upon reading the following detailed description in conjunction with the accompanying drawings.

Figure 1:
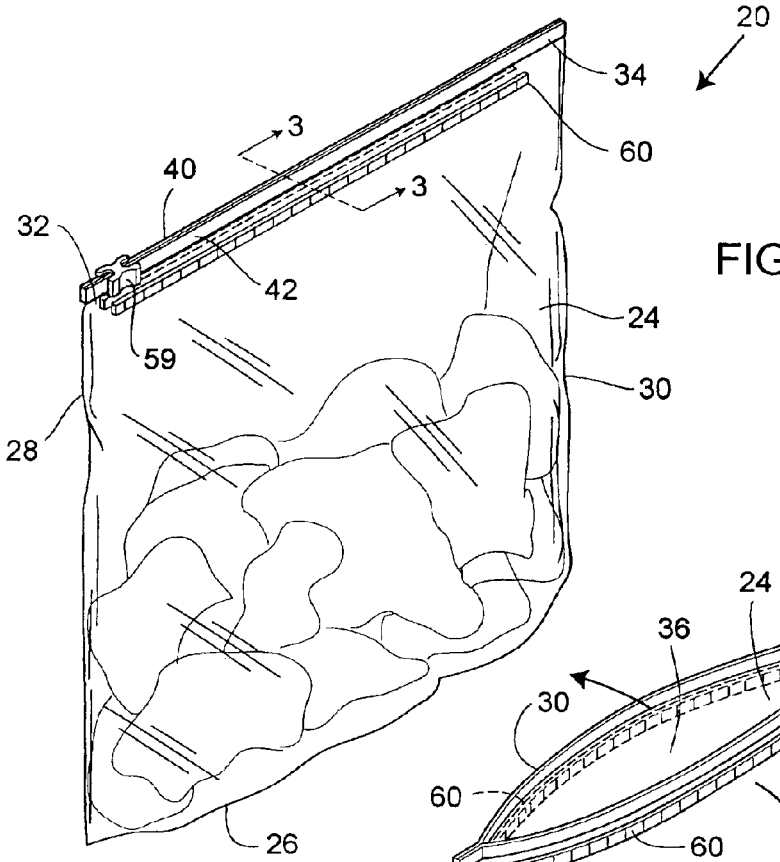
FIG. 1 is an isometric view of a first storage bag constructed in accordance with the teachings of the disclosure and depicted in a closed configuration.

While the disclosure is susceptible to various modifications and alternative constructions, certain illustrative embodiments thereof have been shown in the drawings and will be described below in detail. It should be understood, however, that there is no intention to limit the disclosure to the specific forms disclosed, but on the contrary, the intention is to cover all modifications, alternative constructions, and equivalents falling within the spirit and scope of the invention as defined by the appended claims.

DETAILED DESCRIPTION OF THE PREFERRED EMBODIMENTS

Referring now to the drawings and with specific reference to FIG. 1, a recloseable storage bag constructed in accordance with the teachings of the disclosure is generally referred to by reference numeral 20. While the recloseable storage bag is depicted to have a substantially rectangular configuration in front or rear view, it is to be understood the teachings of the disclosure can be employed with equal efficacy with bags having alternative shapes including, but not limited to, circular, cylindrical, trapezoidal, or polygonal shapes. Moreover, while the bag 20 is depicted and will be described in further detail herein as being transparent, and constructed of thermoplastic material, it is further to be understood that the teachings of the disclosure can be employed with non-transparent bags, as well as those manufactured from other materials including, but not limited to, cellulosic materials.

Figure 2:
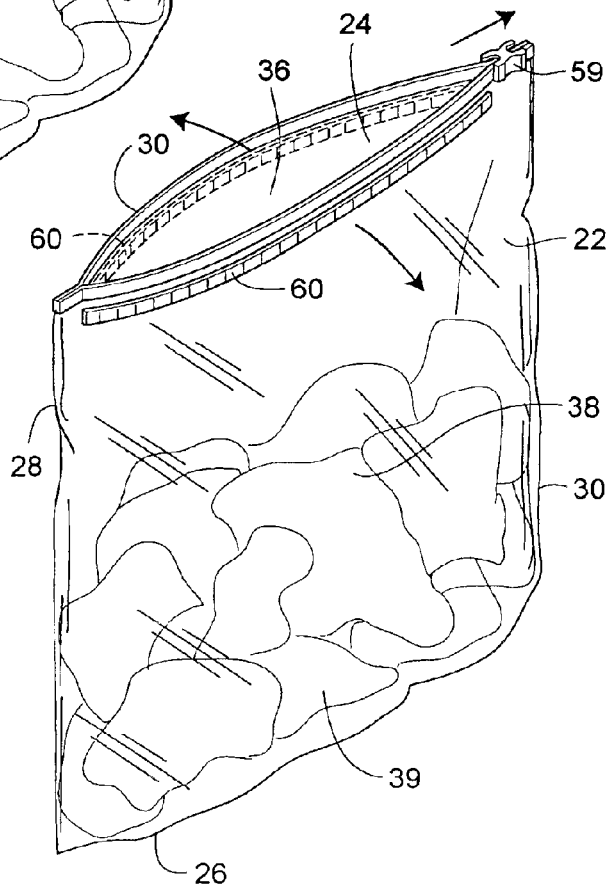
FIG. 2 is an isometric view of the first storage bag constructed in accordance with the teachings of the disclosure and depicted in an open configuration.

Referring now to FIGS. 1 and 2, the bag 20 is depicted to include a first layer 22 and a second layer 24, each of which include a bottom edge 26, a first side edge 28, a second side edge 30, and a top edge 32. The first and second layers 22 and 24 are joined at the bottom edges 26, first side edges 28, and second side edges 30, with the top edges 32 being unconnected but for when a closure device 34 is engaged, as will be described in further detail herein. In so doing, a mouth 36 to a bag interior 38 for receipt of contents 39 is provided proximate the top edges 32. In the depicted embodiment the bottom edges 26 are connected by a fold, and the first side edges 28 and second side edges 30 are connected by heat seals, but is to be understood that heat seals, folds, or any other type of joinder, can be employed at any of the edges 26, 28, or 30. Moreover, the top edges 32 may be joined with the open edge of the bag 20 being provided at any of the other edges 26, 28, or 30.

Figure 3:
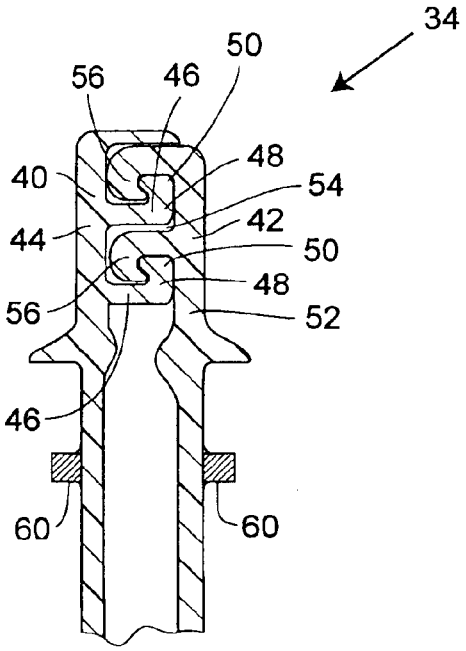
FIG. 3 is a cross-section view taken along line 3—3 of FIG. 1 and depicted with engaged male and female closure profiles.
Figure 4:
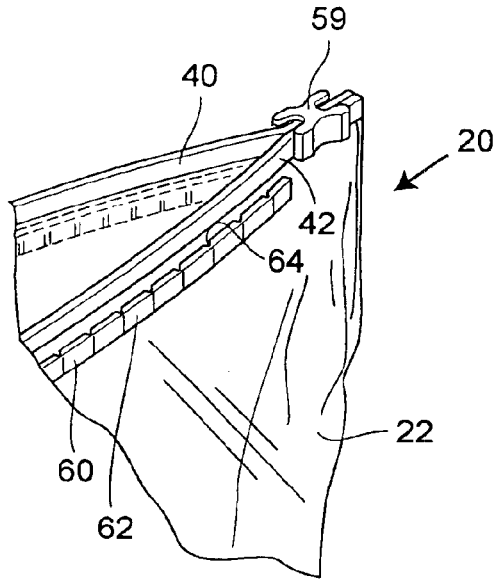
FIG. 4 is an enlarged fragmentary view of a corner of the bag of FIG. 2.

As shown in FIGS. 3 and 4, the closure device 34 may include a male profile strip 40 and a female profile strip 42 adapted to interlock to close the bag mouth 36. In the depicted embodiment, the male profile strip 40 is bonded to the first layer 22, while the female profile strip 42 is bonded to the second layer 24, but it is to be understood that the alternative forms of closure devices, including but not limited to adhesives, tongue and loop fasteners, and folds, may be utilized. Moreover, the male and female strips 40, 42 may be bonded to the second and first layer 24 and second layer 22, respectively, in a variety of manners including, but not limited to, co-extrusion, adhesion, ultrasonic welding, lamination, or the like.

As shown best in FIG. 3, the male profile strip 40 may include a base 44 from which linear tabs 46 extend. The linear tabs 46 may include enlarged ends 48 provided with hooks 50. The female profile strip 42 may include a base 52 in which grooves 54 are provided. The grooves 54 may include a front edge 56 having shoulders 58 adapted to inter-engage with the tab hooks 50. More specifically, as shown in FIG. 3, when the tab 46 is received within the groove 54, as when the male and female profile strips 40, 42 are compressed together, the frictional engagement between the two is sufficient to hold the strips 40 and 42 together until forced apart. For example, a user may grasp the top edges 32 and pull the profiles 40, 42 apart, or a slider element 59 (FIG. 4) may be used to force the strips 40, 42 apart as one of ordinary skill in the art will readily understand. In alternative forms of male and female profiles, the male profile may include only one tab and groove combination, or more than two linear tabs, with the mating female profile having a corresponding number of grooves.

Figure 6:
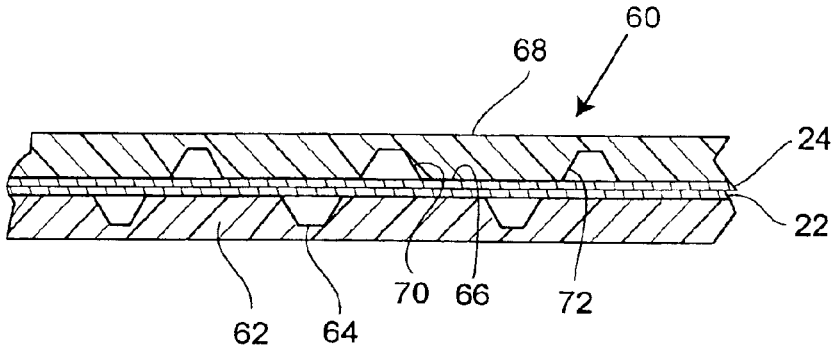
FIG. 6 is a sectional view of the biasing rails of the first storage bag when the bag is closed.
Figure 7:
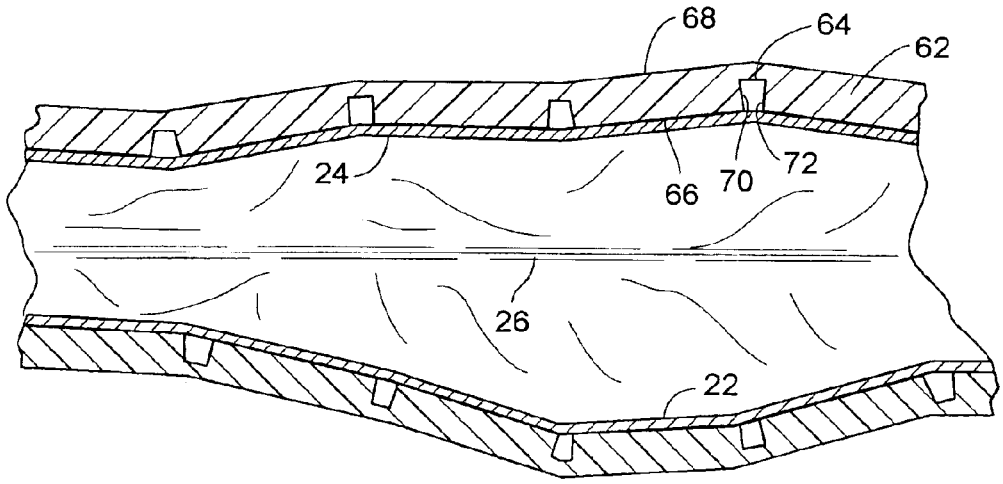
FIG. 7 is a sectional view of the biasing rails of the first storage bag when the bas is open.
Figure 8:
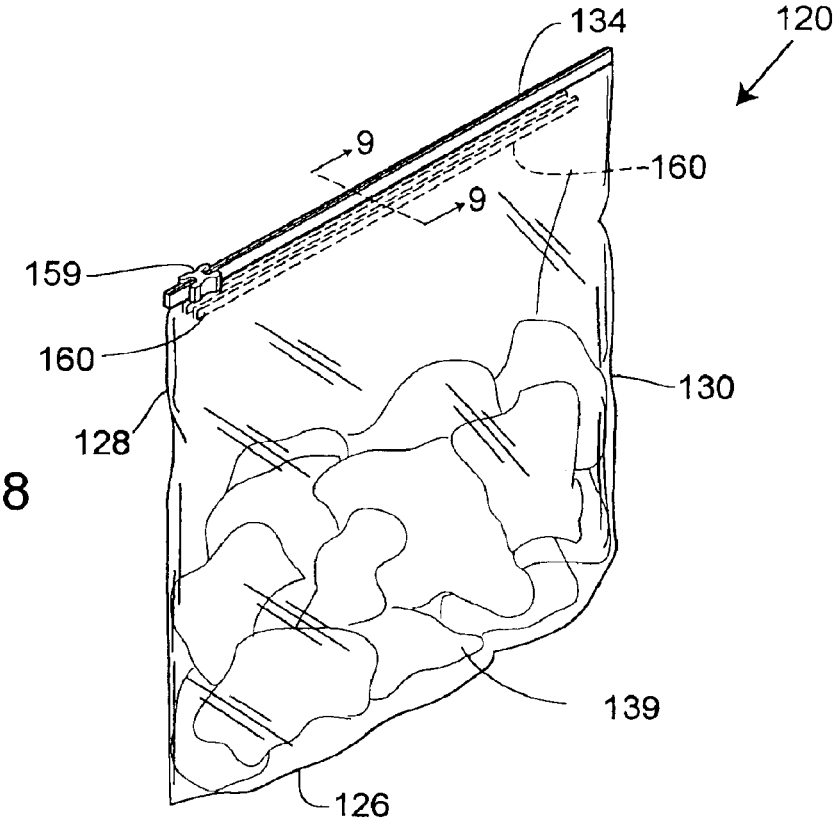
FIG. 8 is an isometric view of a second storage bag constructed in accordance with the teachings of the invention and depicted in a closed configuration.
Figure 9:
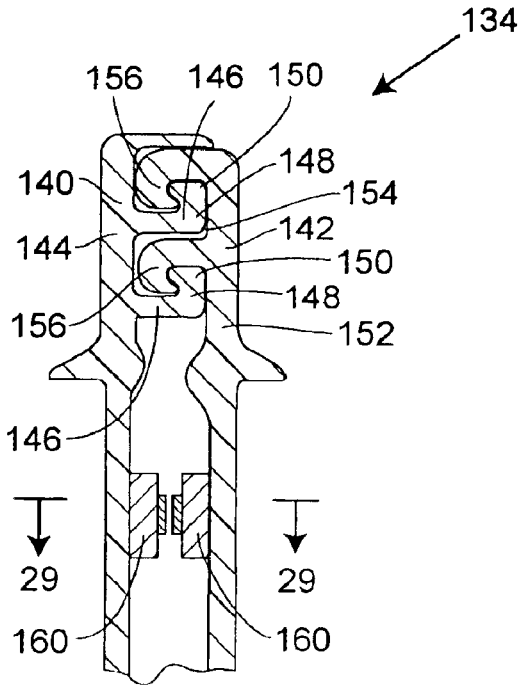
FIG. 9 is a sectional view taken along line 9—9 of FIG. 8.
Figure 10:
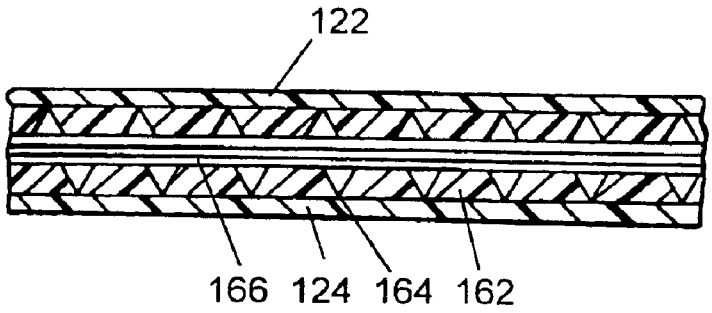
FIG. 10 is a sectional view of the biasing rails of the second bag in a closed position.
Figure 11:
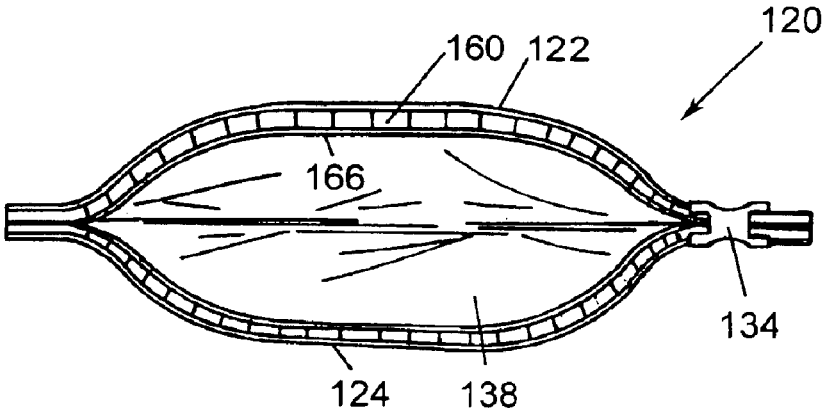
FIG. 11 is section view of the biasing rails of the second bag in an open position.

In order to bias the mouth 36 into an open configuration, a number of structures can be employed. In the depicted embodiment of FIGS. 1–7, the biasing structure is provided in the form of biasing rails 60 provided adjacent the top edges 32. Each of the biasing rails 60 includes a plurality of segments 62 connected by hinges 64. The rails 60 may be manufactured from plastic, such as but not limited to polyethylene, polypropylene, extruded or otherwise formed into a linear length having a rectangular cross-section. The rails 60 may then be die cut or otherwise machined to have a plurality of grooves 62 formed therein and thereby form areas of reduced thickness. Such areas of reduced thickness serve as the hinges 64. As shown best in FIGS. 6 and 7, each of the segments 62 includes a short side 66, a long side 68, and first and second canted ends 70, 72. The ends 70, 72 are preferably canted at intersecting angles relative to one another, the importance of which will be discussed in further detail herein.

Figure 5:
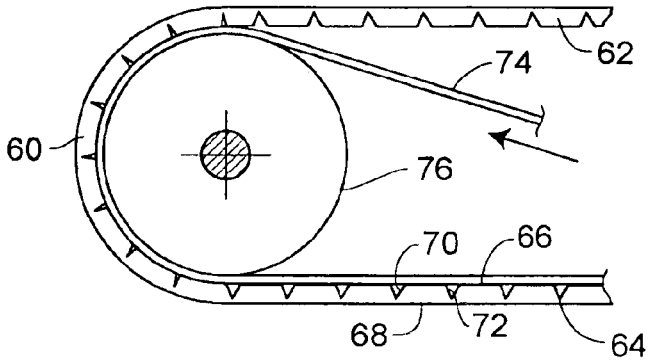
FIG. 5 is a schematic representation of a biasing rail being attached to a thermoplastic web as both traverse around a cylindrical roller.

In the first depicted embodiment, the force required to bias the mouth 36 into an open configuration is provided by both the rails 60, and the method by which the rails are bonded to the first and second layers 22 and 24. Referring now to FIG. 5, a web 74 of the thermoplastic or elastomeric material, used to form the first and second layers 22, 24, is depicted traversing around a cylindrical roller 76. Moreover, the rail 60 is shown being bonded to the web 74 as both traverse around the cylindrical roller 76. More specifically, each of the hinge segments 62 is attached to the web 74 as through spot welding, adhesives, pre-heating, or the like, as both travel in an arcuate path around the cylindrical roller 76. The roller 76 may be independently cooled to facilitate such attachment. The canted ends 70, 72 of adjacent hinged segments 62 are thereby placed into contact as the segments 62 pivot about the hinges 64 to move around the cylindrical roller 76.

A significance of attaching the elements in such an arcuate configuration is that when the rail 60 is placed into a linear configuration, as when the male and female profiles 40, 42 are engaged to close the bag 20, the plastic forming the first and second sides 22, 24 is placed under tension. Such tension results from the hinge segments 62, individually attached to the layers 22, 24, pivoting about the hinges 64 in a direction opposite to that occurring when traversing the roller 76, and pulling against the plastic material of the layers 22, 24. The frictional interference between engaged male and female profiles 40, 42 when the bag 20 is closed is sufficient to overcome the biasing force generated by such tension and maintain the top edges 32 in a closed and linear configuration. However, when the male and female profiles 40, 42 are disengaged, the rails 60 are free to curl about the hinges 64, thereby relieving the tension in the layers 22, 24 and opening the mouth 36. In so doing, it can be seen that the rails 60 have a relaxed, bowed configuration, and a stressed, flattened configuration. In an alternative embodiment, each of the hinges 64 could be filled with a polymer, resin, or the like to force the rail 60 into an arcuate shape.

As indicated above, a variety of materials may be employed to manufacture the bag 20. For example, thermoplastic materials such as, but not limited to, high density polyethylene (HDPE), low density polyethylene (LDPE), linear low density polyethylene (LLDPE), and polypropylene (PP), may be advantageously employed. Other materials which may be used include, but are not limited to, styrenic block copolymers, polyolefin blends, elastomeric alloys, thermoplastic polyurethanes, thermoplastic copolyesters, thermoplastic polyamides, polymers and copolymers of polyvinyl chloride (PVC), polyvinylidene chloride (PVDC), saran polymers, ethylene/vinyl acetate copolymers, cellulose acetates, polyethylene terephthalate (PET), ionomer, polystyrene, polycarbonates, styrene acryloacrylonitrile, aromatic polyesters, linear polyesters, and thermoplastic polyvinyl alcohols.

In a second preferred embodiment illustrated in FIGS. 8–11, an alternative storage bag is generally referred to by reference numeral 120. Wherein elements identical to those of the first embodiment are employed in the second and subsequent embodiments, like reference numerals, with the exception of a preceding one hundred series number (or a two hundred, three hundred, four hundred and so on series number) is employed and will not, for the purpose of clarity, not be described in repetitive fashion herein.

One difference with respect to the second preferred embodiment is provided in the form of a biasing rail 160. As shown best in FIG. 10, the biasing rail 160 still includes a plurality of segments 162 connected by hinges 164 as with the first preferred embodiment, but further includes an elastomeric band 166, such as a rubber band, to provide added biasing force to the bag 120. The elastomeric band 166 may be attached to the biasing rail 160 as by spot welding the elastomeric band 166 to each of the hinged segments 162. When the bag 120 is closed, as shown in FIG. 5, the elastomeric band 166 is stretched into a stressed position. When the male and female profiles 140, 142 are disengaged, the biasing rails 160 and the elastomeric band 166 move into a curled, relaxed position.

Figure 12:
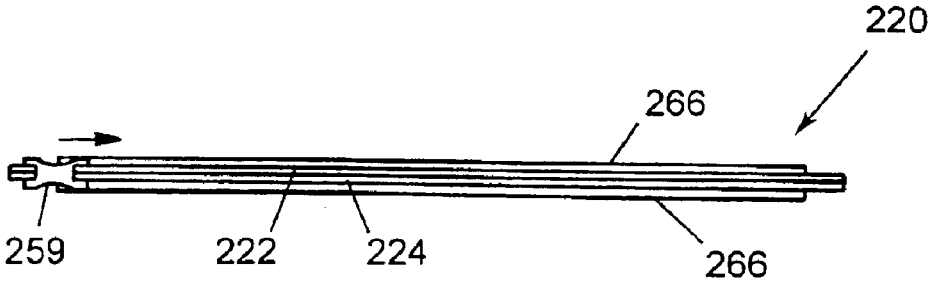
FIG. 12 is top view of a third storage bag constructed in accordance with the teachings of the disclosure and depicted in a closed position.
Figure 13:
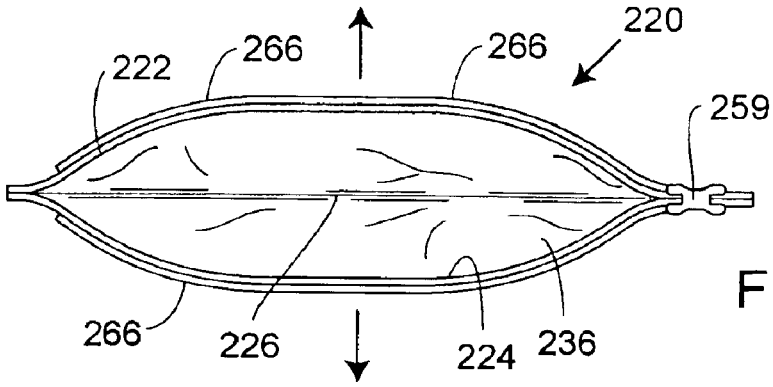
FIG. 13 is a top view of the third storage bag and depicted in an open position.

In a third preferred embodiment, illustrated in FIGS. 12 and 13, a biasing rail is not employed at all, only an elastomeric band 266 is spot welded, under tension, to the first and second layers 222 and 224 when the first and second layers 222 and 224 are in a planar configuration. Accordingly, when the male and female profiles 240 and 242 are disengaged, the elastomeric band is able to retract to a relaxed configuration, thereby biasing the mouth 236 into a bowed, open configuration as depicted.

Figure 14:
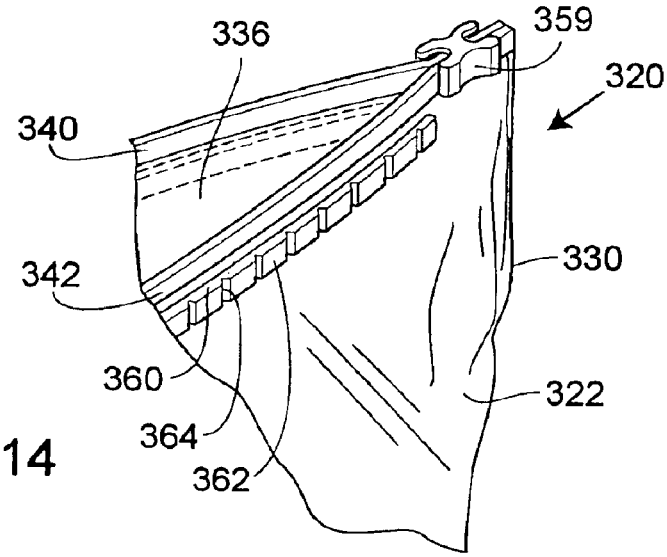
FIG. 14 is an enlarged fragmentary view of a fourth storage bag constructed in accordance with the teachings of the disclosure and depicted in an open position.
Figure 15:
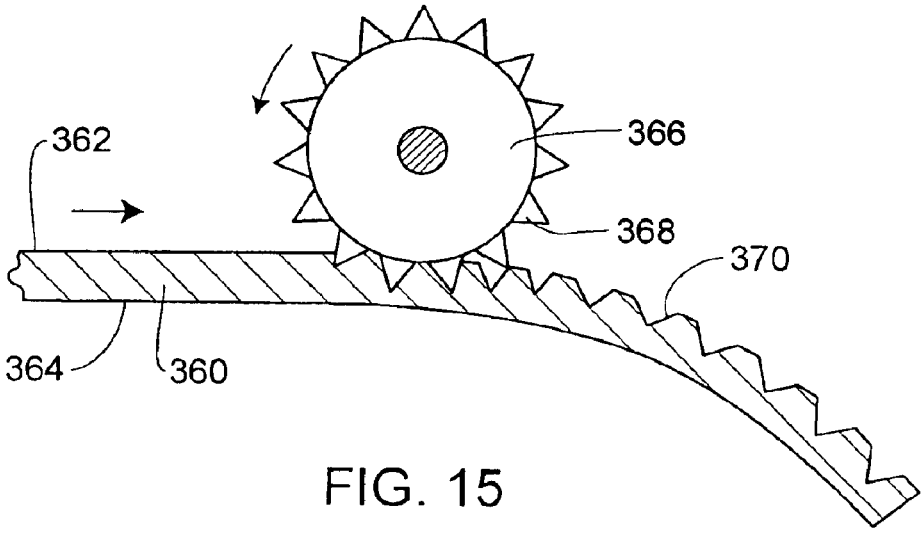
FIG. 15 is a schematic representation of a biasing rail being deformed in accordance with the teachings of the present disclosure.

In a fourth preferred embodiment, illustrated in FIGS. 14 and 15, a biasing rail 360 is deformed prior to attachment to a bag 320. The rail 360 is deformed to have a bowed configuration in its relaxed, unstressed state. The rail 360 includes first and second opposed sides 362 and 364, one of which is deformed and one of which is not. Accordingly, the rail 360 tends to curl away from the stressed side so as to relieve the tension in the rail 360.

The rails 360 are attached to the top edges 332 of the bag 320 such that when they are free to move, they bow outwardly away from one another, thereby biasing the mouth 336 into an open configuration. The biasing force of the rails 360 is less than the closure force generated by the frictional interference between the male and female profiles 340, 342 of the closure device 334. Alternatively, the rail 360 could be integrally extruded with the bag 320. The rail 360 may be made of any number of materials including, but not limited to, plastics and foam rubber.

The first or second sides 362, 364 can be biased in a number of ways. One of ordinary skill in the art will be familiar with coil springs or the like employed in, for example, retractable blinds, or decorative ribbons for packages and the like. In both instances, one side of a linear strip is deformed or stressed causing the strip to curl around the deformed side. The biasing rail 360 can be deformed as depicted in FIG. 15, wherein a deformation wheel or gear 366 having a plurality of deforming teeth 368 rotatably engage the first side 362 to produce a plurality of deformations 370 therein with segments 371 therebetween. The deformation wheel 366 may be powered by a motor, hydraulics, or the like and preferably deforms the rail 360 prior to attachment of the rail 360 to the bag 320. The segments 371 are then laterally compressed so as to partially or fully fill in each of the deformations 370 and thus maintain the rail 360 in a bowed configuration. Alternatively, each of the deformations 370 could be filled with a material, such as but not limited to plastic or foam rubber, to prevent the segments 370 from moving back to a linear orientation and thus preserving a bowed shaped.

Figure 16:
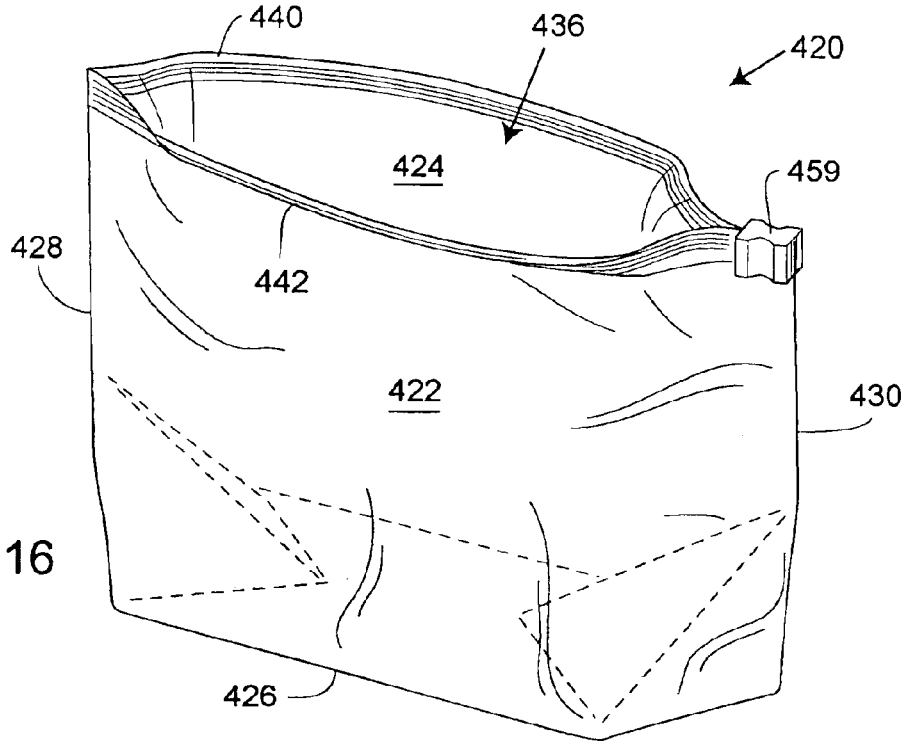
FIG. 16 is an isometric view of a fifth storage bag constructed in accordance with the teachings of the disclosure and depicted in an open position.
Figure 17:
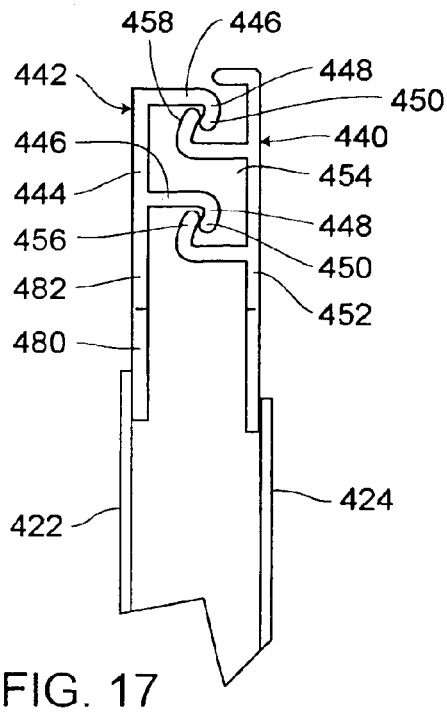
FIG. 17 is sectional view of the closure strips of the fifth storage bag and depicted in a closed position.
Figure 18:
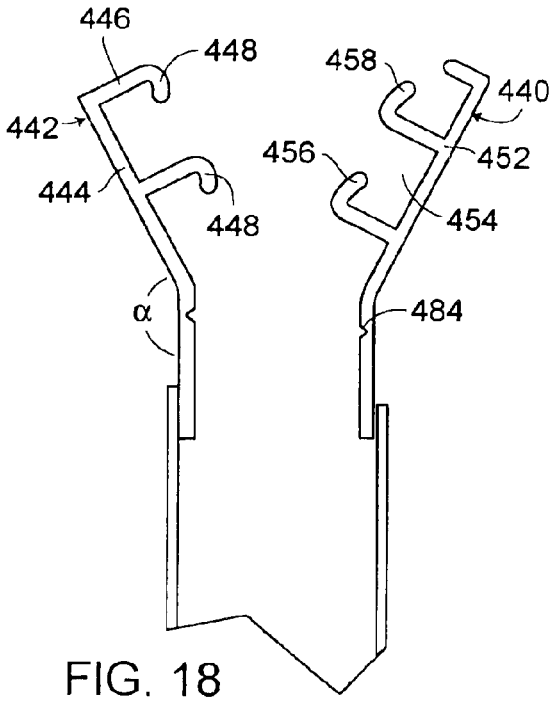
FIG. 18 is a sectional view of the closure strips of the fifth storage bag and depicted in an open position.

In a fifth preferred embodiment illustrated in FIGS. 16–18, a bag 420 also employs a deformed biasing element provided at top edges 432 to bias the bag mouth 436 into an open configuration. However, rather than provide separate rail elements, in the fifth preferred embodiment, the male and female profiles 440 and 442 are themselves deformed to have an angular cant to them, thereby biasing the mouth 436 into an open configuration.

As illustrated, it will be noted that each of the profiles 440, 442 includes a lower section 480 and an upper section 482. The lower sections 450 are bonded to the first and second layers 422, 424 and are parallel thereto. However, the upper sections 482 extend from the lower sections at an angle $\alpha$ when in a relaxed state. The profiles 440, 442 are preferably manufactured from a plastic material having memory characteristics, such as polypropylene, such then when unstressed the profiles 440, 442 return to the angled or canted configuration depicted in FIG. 13, thereby biasing the mouth 436 into an open position. In one embodiment, a linear notch 484 may be provided between the upper and lower sections 482, 480, respectively, to facilitate biasing and bending the profiles.

One of ordinary skill in the art will readily understand that the profiles 440, 442 can be fabricated from a number of materials and according to a number of methods to result in such an angular configuration. For example, the profiles 440, 442 can be extruded through a die (not shown) having an outlet in the desired shape, or injection or blow molded in a mold (not shown) having the desired shape. As indicated above, the material is preferably a plastic material having memory characteristics such as polypropylene, but could be many other types of plastic and metals as well.

Figure 19:
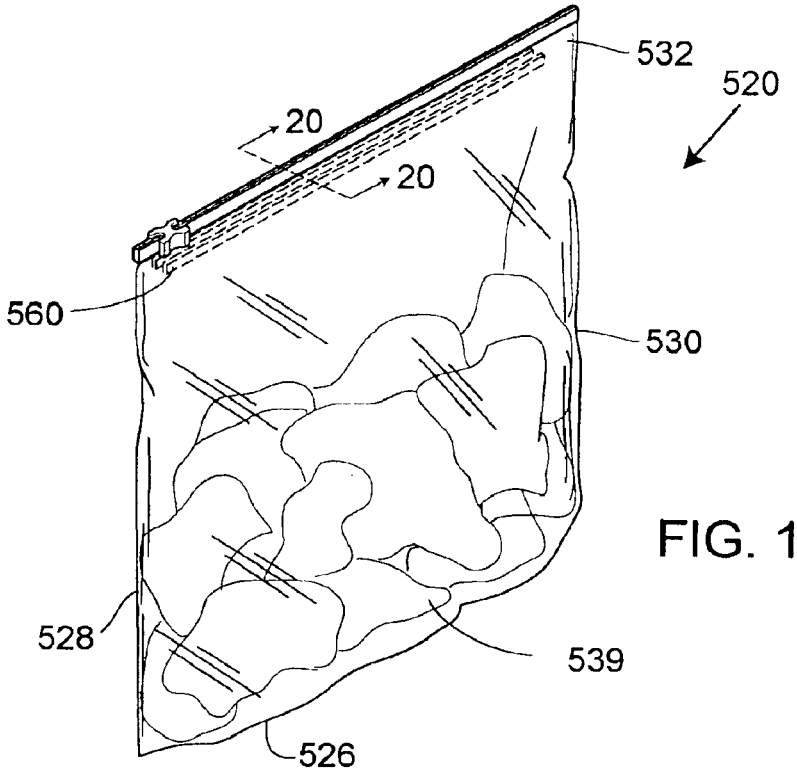
FIG. 19 is an isometric view of a sixth storage bag constructed in accordance with the teachings of the disclosure.
Figure 20:
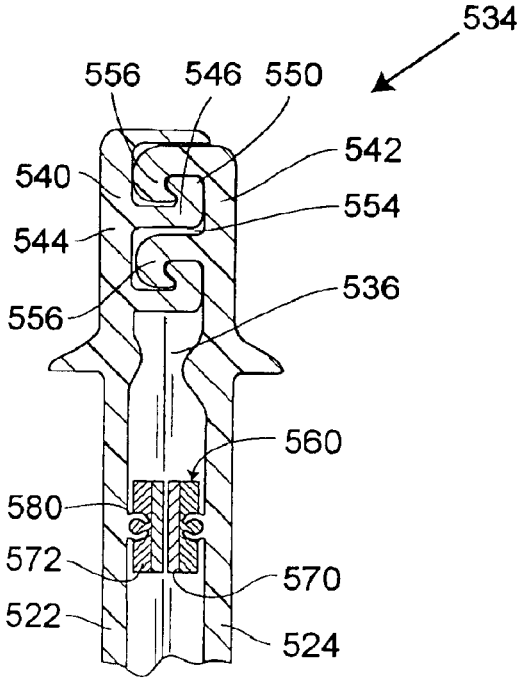
FIG. 20 is sectional view of the sixth storage bag taken along line 20—20 of FIG. 19.
Figure 21:
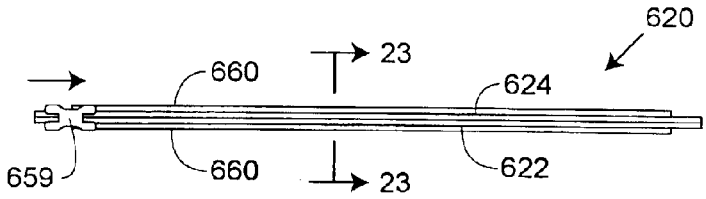
FIG. 21 is a top view of a seventh storage bag constructed in accordance with the teachings of the disclosure and depicted in a closed position.
Figure 22:
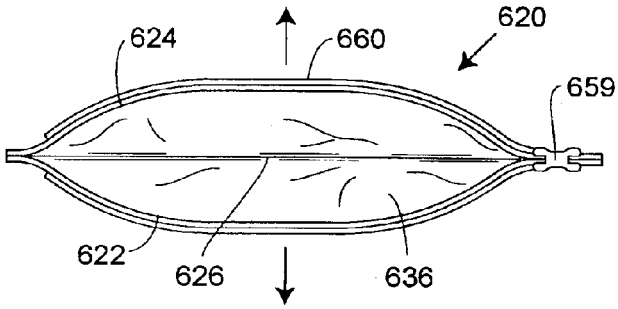
FIG. 22 is a top view of the seventh storage bag constructed in accordance with the teachings of the disclosure and depicted in an open position.
Figure 23:
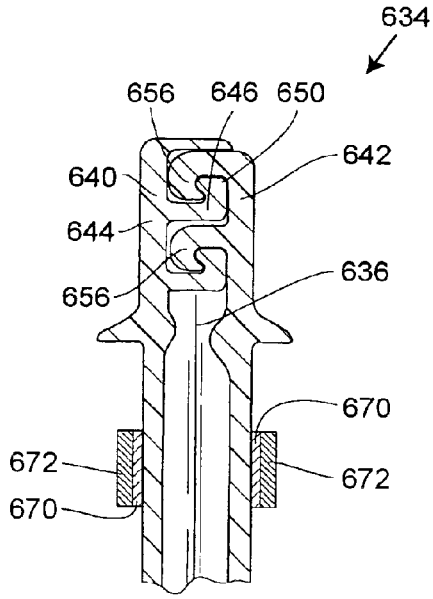
FIG. 23 is a sectional view of the seventh storage bag taken along line 23—23 of FIG. 21.
Figure 24:
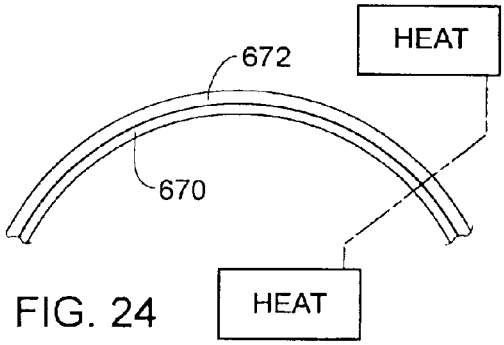
FIG. 24 is a schematic representation of a biasing rail of the seventh storage bag being constructed in accordance with the teachings of the disclosure.

In sixth, seventh and eighth preferred embodiments, multi-layered biasing rails are provided proximate the top edges of the bag to bias the bag into an open configuration. Beginning with the sixth preferred embodiment, illustrated in FIGS. 19 and 20, a bag 520 is provided with biasing rails 560 proximate top edges 532 to bias a mouth 536 into an open configuration. As depicted therein, the bag 520 includes biasing rails 560 on each of the first and second layers 522 and 524 so as to bias the mouth 536 into an open position due to their outward curl.

The biasing rails 560 preferably include inner and outer layers 570, 572 bonded together. Prior to bonding the layers 570, 572 together, the inner layer 570 is placed under tension, as by stretching. Accordingly, when free to move, the inner layer 570 contracts, thereby pulling the outer layer 572, which is connected to the inner layer 570 by way of a tongue and groove coupling or the like, therewith and causing the biasing rail 560 to bow. Since the rails 560 are attached to the top edges 532 of the bag 520, this causes the top edges 532 to bow outwardly away from each other as well, thereby opening the mouth 536. The biasing rail 560 may be manufactured from any suitable plastic material being elastically deformable such as but limited to, for example, polypropylene. Moreover, the rail 560 may be manufactured from a lesser or greater number of layers.

In the seventh preferred embodiment, illustrated in FIGS. 21–24, a bag 620 is provided with multi-layered biasing rails 660 as well. However, rather than stretching one of the layers prior to bonding the layers together, the inner and outer layers 670, 672 are manufactured from materials having different thermal expansion coefficients and are bonded or co-extruded when the materials are heated. Accordingly, when the layers 670, 672 cool, they contract, but contract to different extents due to their different thermal expansion coefficients. Preferably, the inner layer 670 is manufactured from a material having a greater thermal expansion coefficient than the outer layer 672. Due to such material selection, the inner layer 670 contracts to a greater extent than the outer layer. Since the layers 670, 672 are bonded together, the greater contraction of the inner layer 670 pulls the outer layer 672 with the inner layer 670, thereby tending to make the rail 660 bow around the inner layer 670. Moreover, since the inner layer 670 is bonded to the outside of the bag sides 622 and 624, the mouth 636 tends to open upon disengagement of the male and female closure strips 640, 642.

Figure 25:
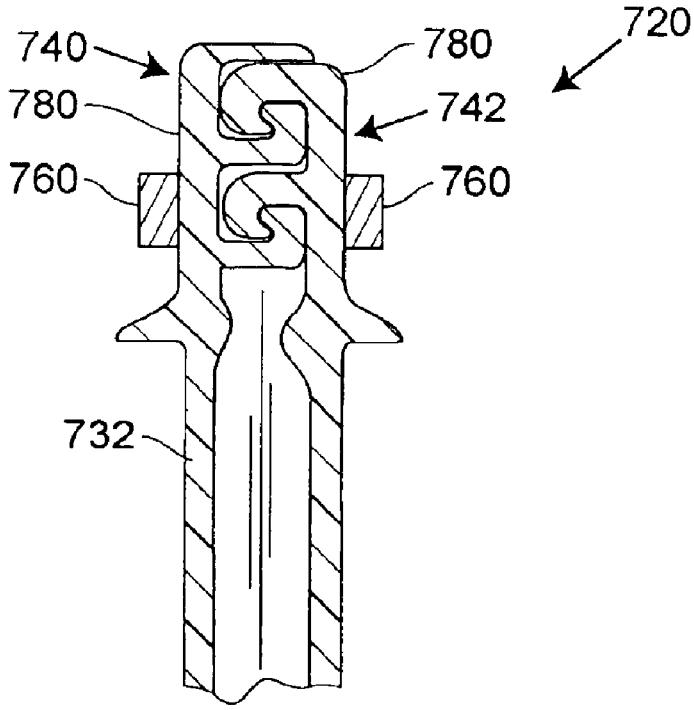
FIG. 25 is sectional view of an eighth storage bag constructed in accordance with the teachings of the disclosure and depicted in a closed position.
Figure 26:
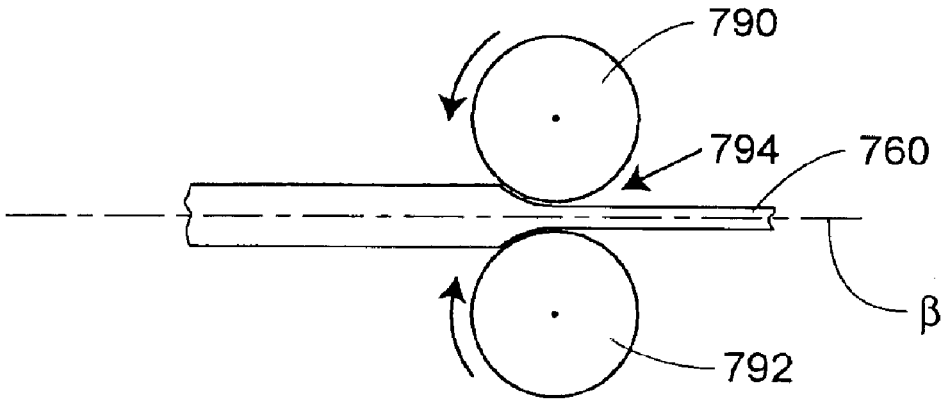
FIG. 26 is a schematic representation of a biasing rail according to the eighth storage bag being constructed according the teachings of the disclosure.

In the eighth preferred embodiment, a bag 720 is again provided with multi-layered biasing structure at top edges 732 of the bag 720. As illustrated in FIGS. 25 and 26, male and female profiles 740, 742 both include a biasing rail 760 therein. Preferably, the profiles 740 and 742 are integrally extruded into the profiles 740, 742 on an outer surface 780 of the male and female profiles 740, 742. After extrusion, or alternative formation, the biasing rail 760 is compressed along its entire length so as to elongate the rail 760 along its entire length in the direction of its longitud axis β.

The elongation of the biasing rail 760 after extrusion places the biasing rail 760 and male and female profiles 740, 742 under tension when flattened. This tension is relieved when the rail 760 curls or bows with the male and female profiles 740, 742 conforming to the bow. Since the rail 760 is provided on the outer surface 780 of the profiles 740, 742, and both are provided at the top edges 732 of the bag 720, the bag mouth 736 tends to open as the rails 760 bow outwardly away from one another when the male and female profiles 740, 742 are disengaged.

The biasing rail 760 may be compressed according to a number of different methods. One non-exclusive method involves passing the rail 760 between a pair of nip rollers 790, 792 as shown in FIG. 26. The nip rollers 790, 792 have a clearance or nip 794 therebetween less than the thickness of the rail 760. Accordingly, as the rail 760 is passed through the nip 794, the rail 760 is compressed, thereby reducing its thickness and elongating its length in a manner similar to a wire drawing operation. Preferably, the rail 760 is manufactured from a more rigid material than the profiles 740, 742 to facilitate bowing thereof.

Figure 27:
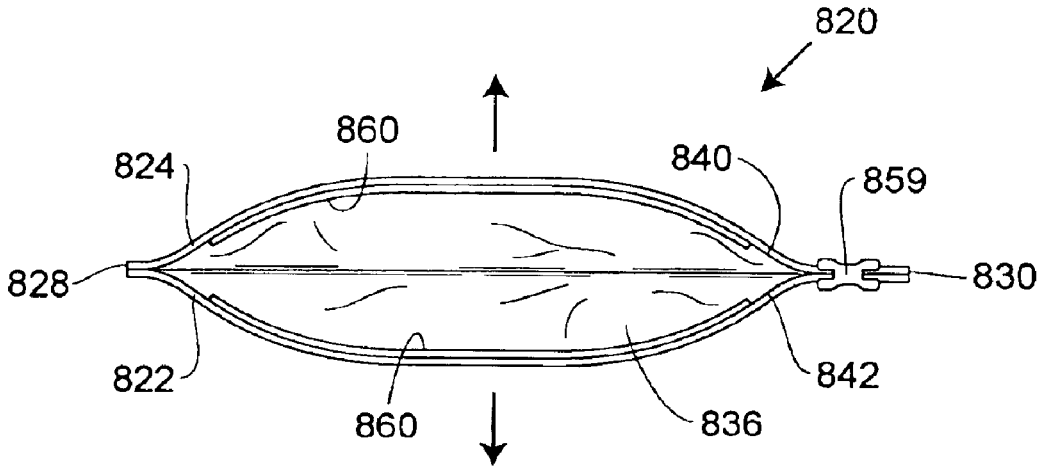
FIG. 27 is a top view of a ninth storage bag constructed in accordance with the teachings of the disclosure and depicted in an open position.
Figure 28:
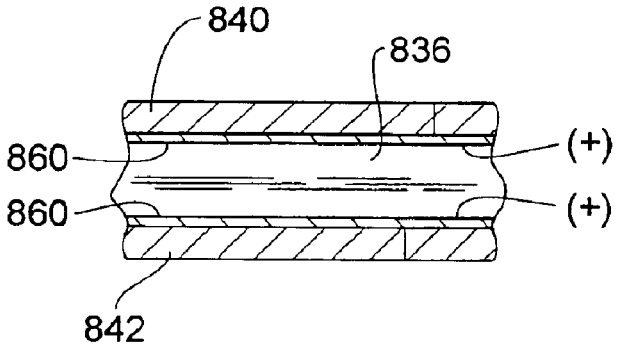
FIG. 28 is an enlarged sectional view of the biasing rails of the ninth storage bag.

In a ninth preferred embodiment, illustrated in FIGS. 27 and 28, a bag 820 is provided having biasing structure provided at top edges 832 utilizing the repelling force of materials of similar polarities. More specifically, the bag 820 includes biasing rails 860 having magnetic or electretic properties. Each of the magnets or electrets have the same polarity, such that they are repelled away from one another. Since the biasing rails 860 are attached to the top edges 832 of the sides 822, 824 of the bag 820, and the sides of the bag are heat sealed or folded along side edges 828, 830, the rails 860 tend to bow away from one another when the male and female profiles 840, 842 are disengaged, thereby opening the mouth 836. The magnets or electrets (defined herein as solid dielectrics exhibiting persistent dielectric polarization) are sized to exhibit a repelling force less than the force generated by the frictional interference between the male and female profiles 840, 842 when the profiles are engaged.

Figure 29:
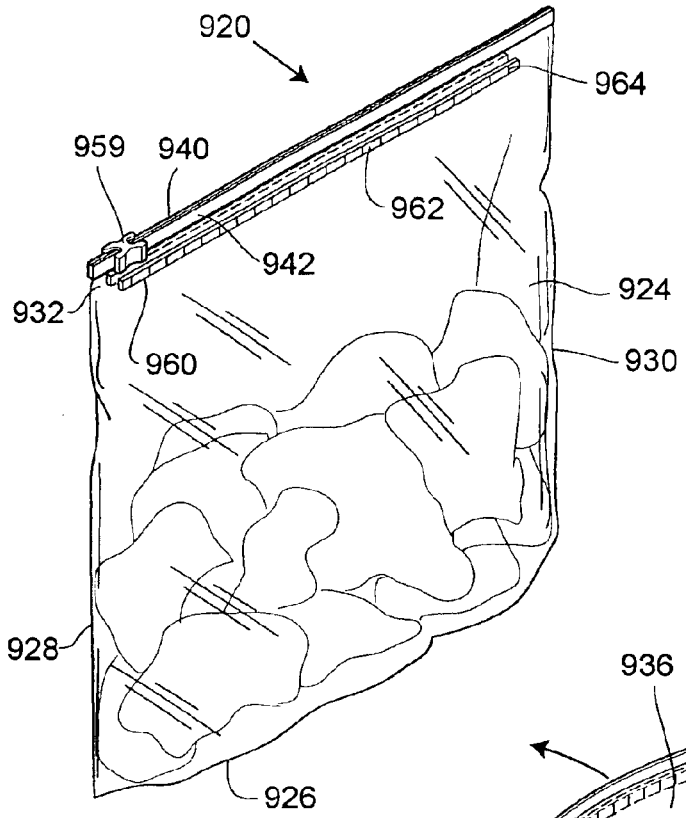
FIG. 29 is an isometric view of a tenth storage bag constructed in accordance with the teachings of the disclosure and depicted in a closed position.
Figure 30:
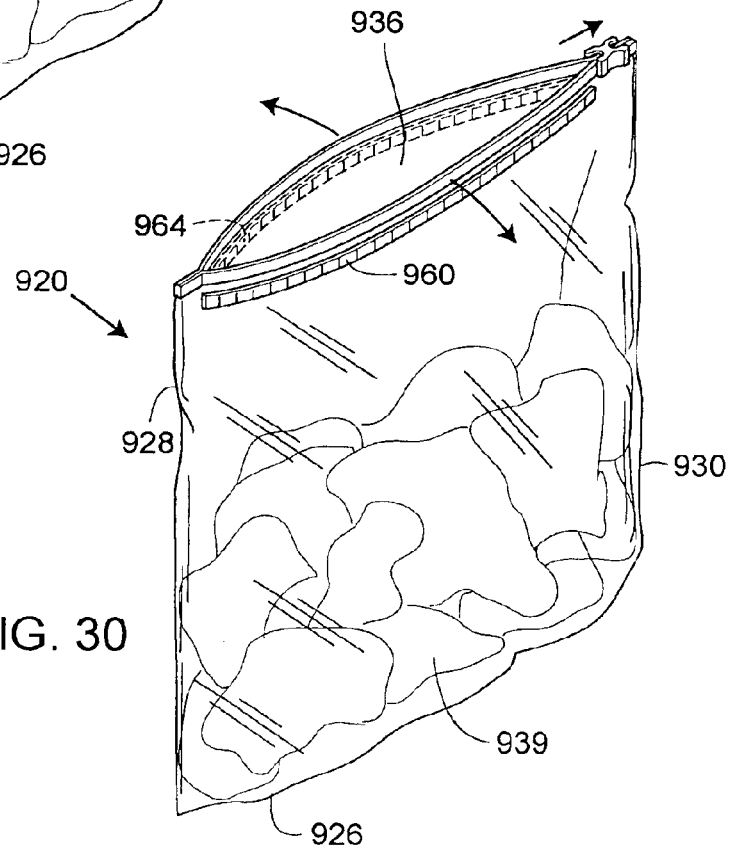
FIG. 30 is an isometric view of the tenth storage bag and depicted in an open position.

In a tenth preferred embodiment, illustrated in FIGS. 29 and 30, a bag 920 is provided having a biasing rail 960 with bi-modal characteristics, defined herein as a device adapted to be moved between first and second stable positions. As illustrated, the biasing rail 960 includes a plurality of segments 962 connected by a series of hinges 964. The rail 960 is stable in a flat or linear configuration wherein the segments are all linearly aligned, and can be snapped into a bowed configuration wherein the segments 962 pivot about hinges 964 to form an arcuate configuration. The rail 960 is stable and tends to stay in the arcuate configuration, until forced back to the linear mode.

The rail 960 is preferably formed by extruding an elongated ridged member, and then die cutting a series of grooves into the ridged member. In order to move the rail 960 from the flattened mode to the arcuate mode, the bag top edges 932 are pulled apart, disengaging the male and female profiles 940, 942 and snapping the rails 932 into position. More specifically, the radius of travel of the hinge segments 962 travels through the thickness of the material used to form the hinges 964. Thus, once the hinging members 962 are swung past the thickness of the material used, the hinging members tend to stay in such a position. Force is required to flatten each hinge segment 962, and thereby achieve the linear mode, after the rail 960 has been snapped into the arcuate mode.

Figure 31:
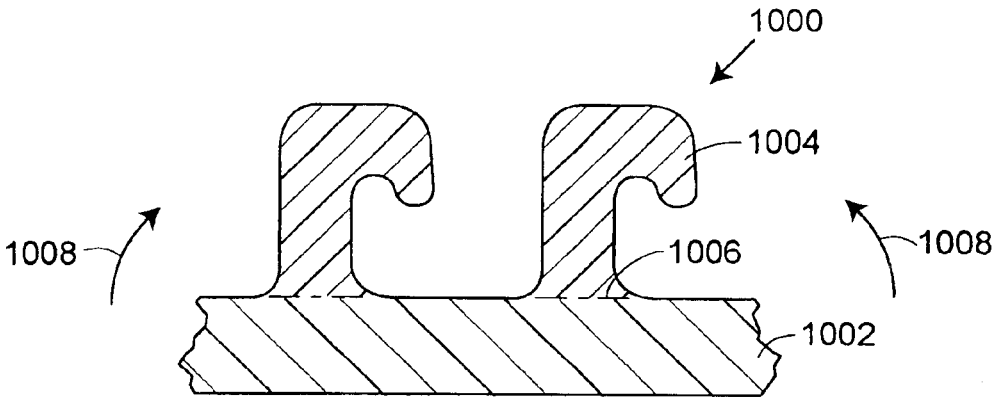
FIG. 31 is a partial sectional view of a closure profile constructed in accordance with the teachings of an eleventh embodiment.
Figure 32:
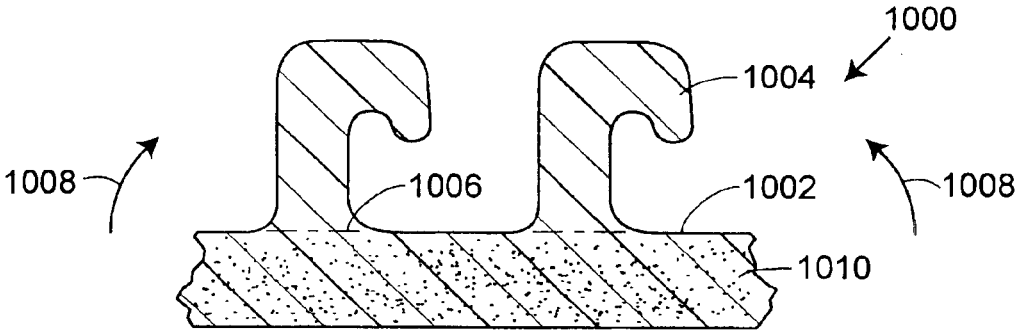
FIG. 32 is a partial sectional view similar to FIG. 31, but depicting different materials being used.
Figure 33:
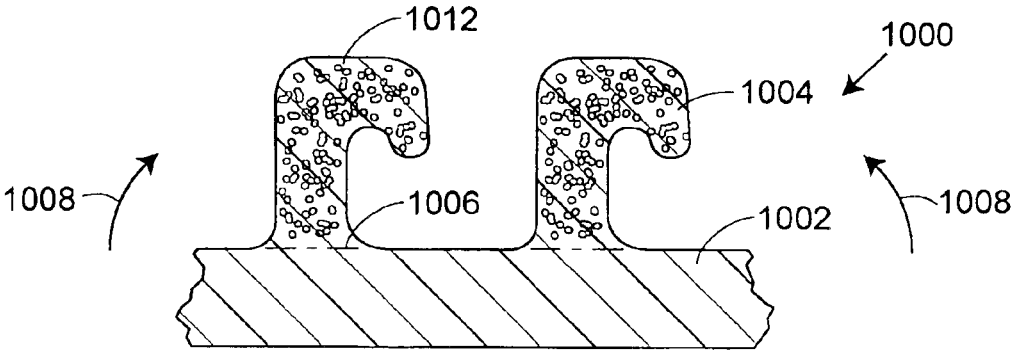
FIG. 33 is another partial sectional view similar to FIGS. 31 and 32, but again showing different materials being used.

In an eleventh preferred embodiment, depicted in FIGS. 31–33, it will be noted that closure profile 1000 can be manufactured from materials having different densities. More specifically, as shown in FIG. 31, the closure profile 1000 may include a base 1002 from which a plurality of interlocking teeth 1004 extend. The first and second materials may be manufactured from polymers having different densities and can be co-extruded so as to form a secure seam 1006 therebetween. For example, the base 1002 could be manufactured from relatively low density polyethylene, while the interlocking teeth 1004 can be manufactured from relatively high density polyethylene. Accordingly, after extrusion, and when the polymers cool, the high density polyethylene will contract to a greater degree than the low density polyethylene, thereby causing the profile to curve in the direction indicated by arrows 1008.

A variation on such a theme is depicted in FIG. 32. The base 1002 is depicted as including an inogranic filler 1010, such as talc or the like. Both the base 1002 and teeth 1004 could be manufactured from the same polyethylene, but by including an inorganic filler material in the base 1002, the density of the base 1002 again is lower than the density of the teeth 1004, thereby causing the profile 1000 to again curl in the direction of arrows 1008.

A still further variation on such a theme is depicted in FIG. 33 where again the base 1002 and teeth 1004 are manufactured from the same polyethylene material, but the teeth are manufactured so as to include a plurality of voids or air bubbles 1012 therein. Since the voids 1012 are filled with air when extruded, the air therein has a much greater volume than at room temperature. Accordingly, upon cooling, the air reduces in volume to a relatively large degree, thereby causing the teeth to contract more so than the base 1002 and thus again causing the profile 1000 to curl in the direction of arrows 1008. While not depicted, such air bubbles 1012 could be provided in the teeth 1004, by providing a source of air directly in the extruder. More specifically, a conduit or manifold having a plurality of relatively small apertures could be provided in the stream of extruded plastic to intermittedly introduce bursts of air therein to thereby provide the air bubbles.

Figure 34:
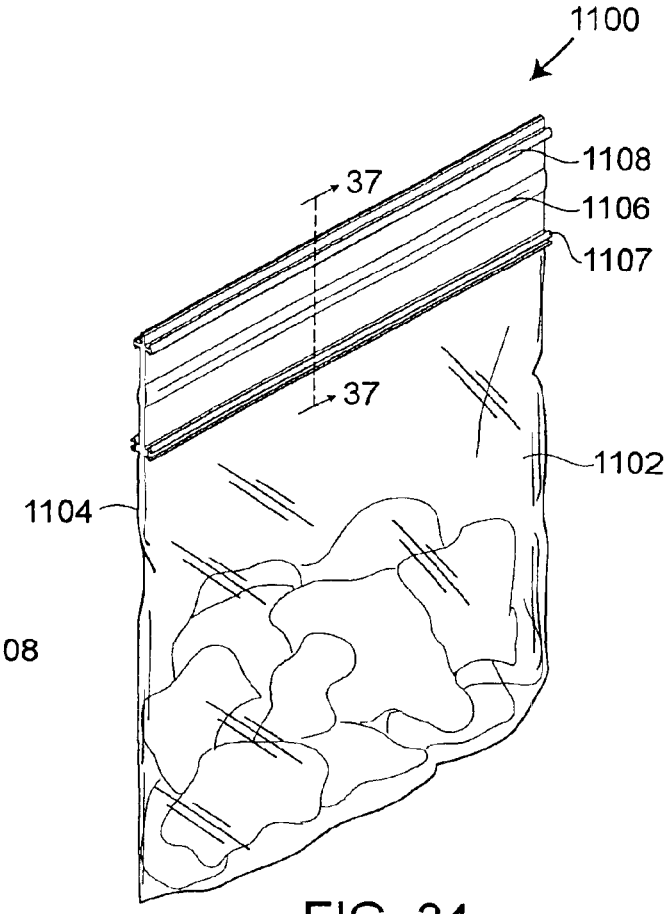
FIG. 34 is an isometric view of an eleventh embodiment of a bag constructed in accordance with the teachings of the disclosure.
Figure 35:
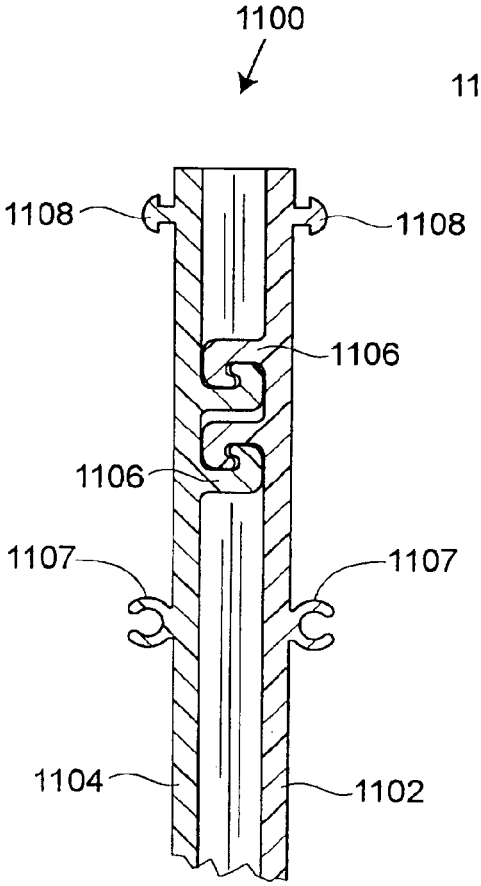
FIG. 35 is a sectional view taken along the line 35—35 of FIG. 34.
Figure 36:
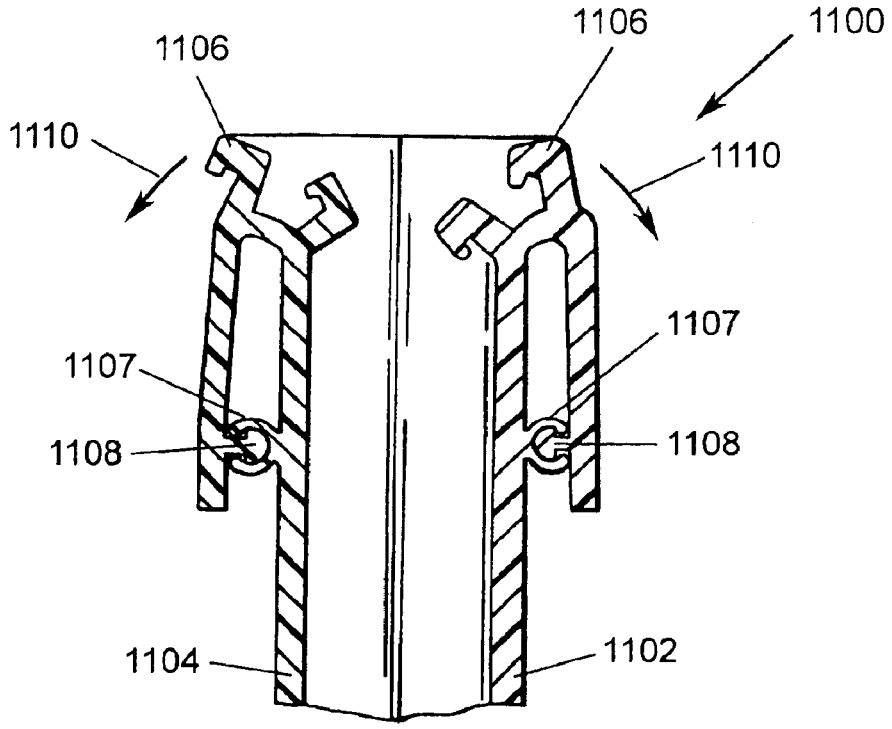
FIG. 36 is a sectional view similar to that of FIG. 35, but depicting the bag in an open position.

In a twelfth preferred embodiment, depicted in FIGS. 34–36, a bag 1100 is provided which can be inverted from the position shown in FIG. 35 to that shown in FIG. 36. More specifically, as shown in FIG. 34, the bag 1100 may include first and second sides 1102, 1104 each having closure profiles 1106. However, in addition, stay open closure profiles may also be provided such as a female stay-open or inversion profile 1107 and a male stay-open or inversion profile 1008. Upon opening or separating the main closure profiles 1106, the first and second sides 1102, 1104 can be inverted such that the male stay open closure profiles 1108 engage and frictionally lock into the female stay open closure profiles 1107 as shown in FIG. 36, by arrows 1110. In so doing, not only is the bag 1100 open and maintained in an open position, the rigidity provided by the inversion of the sides 1102, 1104 naturally causes the bag 1100 to maintain an open configuration.

Figure 37:
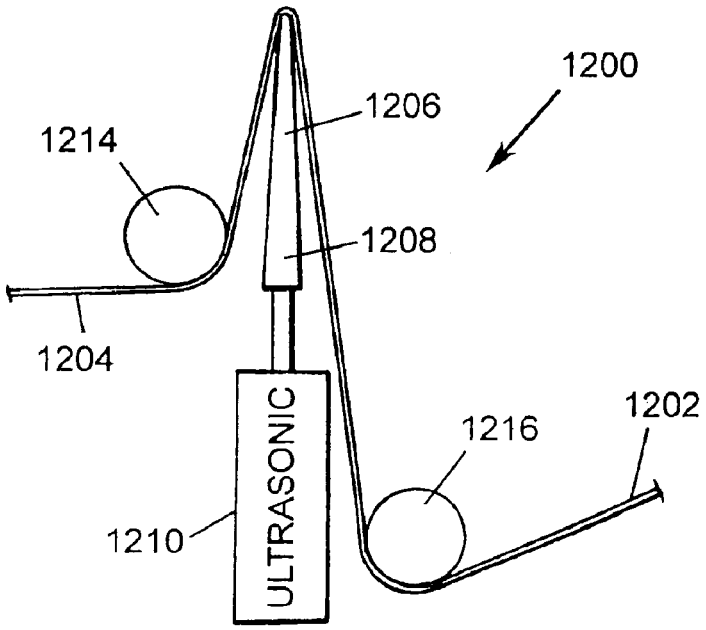
FIG. 37 is a machine adapted to construct a bag in accordance with the teachings of the disclosure according to a twelfth embodiment.

Finally, in a thirteenth embodiment depicted in FIG. 37, an apparatus 1200 can be provided for manufacturing a closure profile 1202. Similar to the embodiment depicted in FIG. 15, the profile 1202 can be deformed on a first side 1204 to thereby cause the profile 1202 to have a natural arcuate shape. Such deformation can be accomplished simply by dragging the profile 1202 across a sharp edge or knife 1206 to thereby remove material or otherwise deform the material on a first side of the strip. However, given the relatively high degree of drag which would be created between the sharp edge 1206 and the closure strip 1202, the sharp edge 1206 may be mounted atop a bearing surface 1208 to alleviate such drag. For example, the bearing surface 1208 could be provided in the form of an ultrasonic vibrator 1210 which would vibrate at a frequency sufficient to alleviate the drag, but still ensure contact of the sharp edge 1206 against the strip 1202 to thus deform the strip 1202. In addition, it should be noted that the machine 1200 would be provided with tensioning rolls 1214, 1216 to ensure that the strip is pulled across the sharp edge 1206 with sufficient force so as to deform the first side 1204. In alternative embodiments, different forms of bearing surfaces can certainly be provided.

From the foregoing, one of ordinary skill in the art will readily understand that the teachings of the disclosure can be employed to construct a storage bag having an improved pop-open or stay-open mouth.

What is claimed is:

1. A recloseable storage bag, comprising:

a first side having a bottom edge, left edge, right edge, top edge, inner surface, and outer surface;

a second side having a bottom edge, left edge, right edge, top edge, inner surface, and outer surface, the bottom edges of the first and second sides being attached, the left edges of the first and second sides being attached, and the right edges of the first and second sides being attached;

closure members being provided proximate the top edges of the first and second sides; and biasing rails attached to the first and second sides, each biasing rail having a relaxed, outwardly biased configuration, and a stressed, flat configuration, the closure members having a closure force, the biasing rails having an opening force, the closure force being greater than the opening force, each biasing rail including a plurality of hinged segments separated by a plurality of voids, each hinged seaments being individually secured to the first and second sides, the first and second sides proximate each void being under tension when the bag is closed and relaxed when the bag is open.

2. The recloseable storage bag of claim 1, wherein the biasing rails are attached to the first and second sides as both traverse a semi-circular path.

3. The recloseable storage bag of claim 1, wherein the biasing rails are attached to the outer surface of the first and second sides.

4. The recloseable storage bag of claim 1, wherein the biasing rails are attached to the inner surfaces of the first and second sides.

5. The recloseable storage bag of claim 1, wherein the closure members are mating male and female zipper strips.

6. The recloseable storage bag of claim 5, wherein the closure members further include a sliding member adapted to facilitate closing and opening of the male and female zipper strips.

7. The recloseable storage bag, comprising:

a first side having a bottom edge, left edge, right edge, top edge, inner surface, and outer surface;

a second side having a bottom edge, left edge, right edge, top edge, inner surface, and outer surface, the bottom edges of the first and second sides being attached, the left edges of the first and second sides being attached, and the right edges of the first and second sides being attached;

closure members being provided proximate the top edges of the first and second sides; and biasing rails attached to the first and second sides, each biasing rail having a relaxed, outwardly biased configuration, and a stressed, flat configuration, the closure members having a closure force, the biasing rails having an opening force, the closure force being greater than the opening force, each biasing rail including a plurality of hinged segments, the hinged segments having at least two canted ends; each of the hinged segments being substantially trapezoidal in linear cross-section.

8. A recloseable storage bag, comprising:

a pouch having an access way to an interior storage area of the pouch;

a closure device proximate to the access way, the closure device being moveable between an engaged position closing the access way and a disengaged position opening the access way;

means for biasing the access way into an open configuration when the closure device is disengaged, the means for biasing including a rail having a plurality of hinged segments, each hinged segment being substantially trapezoidal in linear cross-section.

9. The recloseable storage bag of claim 8, wherein the rail is bonded to the pouch while both the rail and the pouch are positioned in an arcuate configuration.

10. The recloseable storage bag of claim 8, wherein the pouch is manufactured from thermoplastic material.

11. The recloseable storage bag of claim 8, wherein the closure device includes mating male and female profile strips.

* * * * *